US009020168B2

(12) United States Patent
Karkkainen et al.

(10) Patent No.: US 9,020,168 B2
(45) Date of Patent: Apr. 28, 2015

(54) APPARATUS AND METHOD FOR AUDIO DELIVERY WITH DIFFERENT SOUND CONDUCTION TRANSDUCERS

(75) Inventors: Leo Karkkainen, Helsinki (FI); Lance Williams, Toluca Lake, CA (US); Peng Xie, Burbank, CA (US)

(73) Assignee: Nokia Corporation, Espoo (FI)

( * ) Notice: Subject to any disclaimer, the term of this patent is extended or adjusted under 35 U.S.C. 154(b) by 560 days.

(21) Appl. No.: 13/221,121

(22) Filed: Aug. 30, 2011

(65) Prior Publication Data

US 2013/0051585 A1 Feb. 28, 2013

(51) Int. Cl.

| | |
|---|---|
| ***H04R 25/00*** | (2006.01) |
| ***H04R 1/10*** | (2006.01) |
| *H04R 3/14* | (2006.01) |

(52) U.S. Cl.

CPC ..... *H04R 1/1075* (2013.01); *H04R 3/14* (2013.01); *H04R 2460/13* (2013.01)

(58) Field of Classification Search

USPC ..... 381/99, 309, 326, 327, 328, 151, 370, 381/374, 376, 380, 381, 382; 181/129, 130, 181/135; 379/430

See application file for complete search history.

(56) References Cited

U.S. PATENT DOCUMENTS

| | | | | |
|---|---|---|---|---|
| 2,062,373 | A | 12/1936 | Nicholides | 179/107 |
| 2,127,468 | A | 8/1938 | Greibach | 179/107 |
| 2,249,572 | A | 7/1941 | Lieber | 179/107 |
| 2,613,282 | A | 10/1952 | Schaife | 179/107 |
| 2,720,559 | A | 10/1955 | Thomas | 179/156 |
| 4,548,082 | A * | 10/1985 | Engebretson et al. | 73/585 |
| 5,367,345 | A | 11/1994 | da Silva | 351/123 |
| 5,692,059 | A * | 11/1997 | Kruger | 381/151 |
| 5,986,813 | A | 11/1999 | Saikawa et al. | 359/639 |
| 6,301,367 | B1 | 10/2001 | Boyden et al. | 381/376 |
| 6,728,374 | B1 | 4/2004 | Takeda | 379/433.02 |
| 6,957,949 | B2 | 10/2005 | Hyde et al. | 455/90.3 |
| 7,736,321 | B2 | 6/2010 | Wasden et al. | 600/559 |
| 8,447,061 | B2 * | 5/2013 | Lee | 381/380 |
| 2002/0012441 | A1 * | 1/2002 | Matsunaga et al. | 381/381 |
| 2002/0197961 | A1 | 12/2002 | Warren | 455/66 |
| 2004/0197002 | A1 | 10/2004 | Atsumi et al. | 381/380 |
| 2005/0128431 | A1 | 6/2005 | Jannard et al. | 351/158 |
| 2007/0223735 | A1 * | 9/2007 | LoPresti et al. | 381/99 |
| 2008/0008344 | A1 | 1/2008 | Wakabayashi et al. | 381/327 |
| 2008/0112581 | A1 * | 5/2008 | Kim et al. | 381/151 |
| 2008/0273163 | A1 | 11/2008 | Sasaki | 351/113 |

FOREIGN PATENT DOCUMENTS

| | | | |
|---|---|---|---|
| EP | 0 936 839 | A1 | 8/1999 |
| EP | 2 254 345 | A1 | 11/2010 |
| GB | 723981 | A | 11/2010 |
| JP | 2182098 | A | 7/1990 |
| JP | 2006109192 | A | 4/2006 |
| WO | WO-2009/101622 | A2 | 8/2009 |
| WO | WO-2010/114195 | A1 | 10/2010 |

* cited by examiner

*Primary Examiner* — Huyen D Le
(74) *Attorney, Agent, or Firm* — Harrington & Smith

(57) ABSTRACT

An apparatus including an air-conduction transducer and a bone conduction transducer. The air-conduction transducer is configured to convert a first frequency band component of an electrical audio signal into acoustic energy to be delivered to an ear canal of a user. The bone conduction transducer is configured to convert a second, at least partially different, frequency band component of the electrical audio signal into mechanical energy to be delivered to a skull of the user. The apparatus is configured to deliver both forms of the energies to the user at a substantially same time to provide a combined audio delivery result to the user.

13 Claims, 8 Drawing Sheets

APPARATUS AND METHOD FOR AUDIO DELIVERY WITH DIFFERENT SOUND CONDUCTION TRANSDUCERS

BACKGROUND

1. Technical Field

The exemplary and non-limiting embodiments of the invention relate generally to audio and, more particularly, to communicating audio to a user.

2. Brief Description of Prior Developments

Audio headphones, headsets and earbuds having air-conduction transducers are known. Devices worn on a user's head having a bone conduction transducer are also known.

SUMMARY

The following summary is merely intended to be exemplary. The summary is not intended to limit the scope of the claims.

In accordance with one aspect, an apparatus is provided including one or more air-conduction transducers and a body vibration conduction transducer. The one or more air-conduction transducers are configured to convert a first frequency band component of an electrical audio signal into acoustic energy to be delivered to one or more ears of a user. One or more body vibration conduction transducers are configured to convert a second, at least partially different, frequency band component of the electrical audio signal into mechanical energy to be delivered to a hearing system of the user. The apparatus is configured to deliver both forms of the energies to the user at a substantially same time to provide a combined audio delivery result to the user.

In accordance with one aspect, a method comprises delivering a first component of an electrical audio signal to a first transducer, where the first component comprises a high-frequency band of the electrical audio signal, and where the first transducer is configured to convert the first component into acoustic energy; and delivering a second component of the electrical audio signal to a second different transducer, where the second component comprises a low-frequency band of the electrical audio signal. The second transducer is a body vibration conduction transducer configured to deliver vibration to a skull of a user. The acoustic energy and the vibrations are delivered to the user at substantially a same time for a combined audio delivery result.

In accordance with another aspect, an apparatus is provided comprising a first transducer; a second different transducer comprising a body vibration conduction transducer; and a crossover connected to the first and second transducers. The crossover is configured to separate an electrical audio signal into a first frequency band component and a second frequency band component. The second frequency band component is at least partially different from the first frequency band component. The apparatus is configured to provide the first component to the first transducer and the second component to the body vibration conduction transducer.

In accordance with another aspect, a method comprises connecting a first transducer to a crossover, where the crossover is configured to form an incoming electrical audio signal into a first frequency band component and a second frequency band component, where the second frequency band component is at least partially different from the first frequency band component, and where crossover is configured to send the first frequency band component to the first transducer; and connecting a second different transducer to the crossover, where the second transducer comprises a body vibration conduction transducer, where the crossover is configured to send the second frequency band component to the body vibration conduction transducer.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
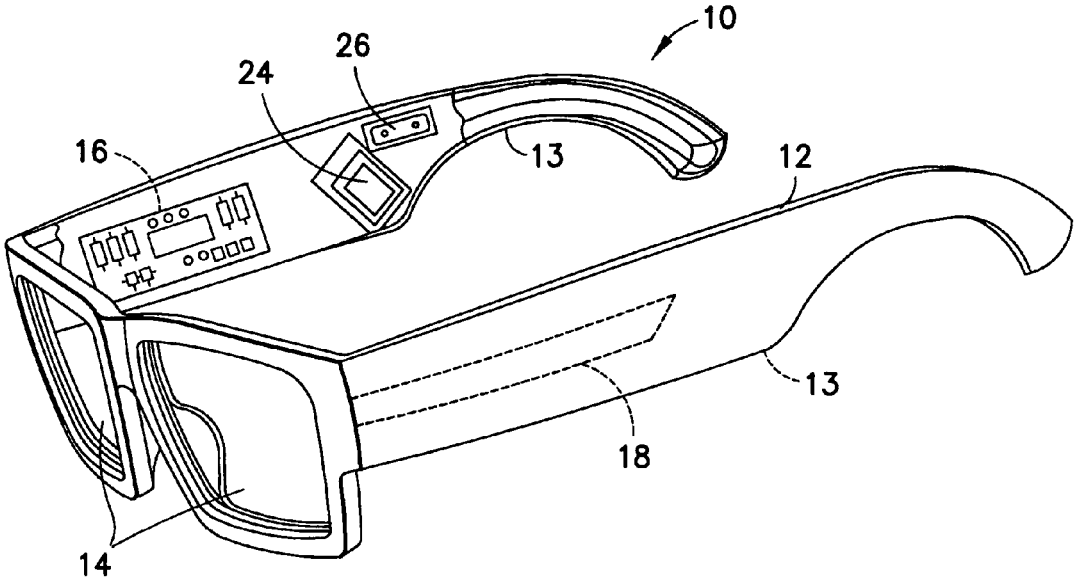
FIG. 1 is a perspective view with a cut away section of one example embodiment.

Referring to FIG. 1, there is shown a perspective view of an apparatus 10 incorporating features of an example embodiment. Although the features will be described with reference to the example embodiments shown in the drawings, it should be understood that features can be provided in many alternate forms of embodiments. In addition, any suitable size, shape or type of elements or materials could be used.

The apparatus 10 in this example comprises an eyeglass frame 12. However, in alternate embodiments any suitable type of frame could be provided which is configured to be worn or supported by a user's head. The frame and other features are, thus, referred to generally as a headset herein. In the example shown the headset 10 generally comprises the frame 12, windows 14, and electrical circuitry 16. The headset could also comprise a battery 18.

Figure 2:
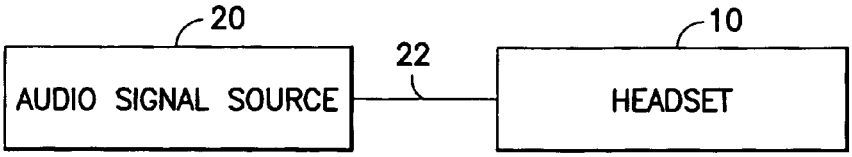
FIG. 2 is a diagram illustrating connection of the example shown in FIG. 1 to an audio signal source.

Referring also to FIG. 2, the headset 10 is configured to be connected to a source 20 of an audio signal via a link 22. The link 22 could be a wireless connection (e.g., radio frequency, infrared, or ultrasound), a wired connection (e.g., optical fiber) or a combination of a wired connection and a wireless connection. In one type of embodiment the link 22 could be multiple links, perhaps to one or more sources. The source 20 could comprise, for example, a mobile telephone, a smartphone, a PDA, a computer, a music player, a video player, or any other type of device adapted to output an audio signal.

In the example shown in FIG. 1 the windows 14 comprise displays adapted to display images in front of a user's eyes. In an alternate embodiment the windows could comprise prescription lens, 3D picture lens, or stereo lenses that could separate the views by color, polarization, or synchronized shutter, for example. The electrical circuitry 16 can comprise suitable electronics to display an image on the windows or control the windows such as for 3D picture viewing for example. The circuitry 16 can include a receiver and an antenna for receiving signals including audio, video, and/or other data from the source 20. Alternatively, or additionally, the circuitry could be connected by one or more wires to the source 20, such as connected by a removable plug and wire. The circuitry 16 might also comprise a transmitter for sending signals from the headset to the source 20 or to another device. The circuitry 16 could include a processor and a memory.

The circuitry 16 includes multiple transducers including a first transducer 24 and a second transducer 26. The frame 12 in this eyeglass type of form factor has temple arms 13 adapted to be placed over the ears. The transducers 24, 26 are preferably provided in each temple arm 13. The first transducer 24 in this example is an air-conduction transducer configured to convert an electrical signal into acoustic energy or sound waves. The frame 12 has a suitable aperture for each first transducer 24 proximate the portion of the temple arm 13 which contacts the ear. This allows the sound from the first transducer to exit the frame proximate the ear canal of the user. The second transducer 26 in this example is a body vibration conduction transducer, such as a bone conduction transducer configured to convert an electrical signal into mechanical energy or vibrations. The second transducer 26 can be located against the skin of the user, close to bone, to send vibrations to the skull. The second transducer can be used for bone conduction which is the conduction of sound to the inner ear through the bones of the skull.

Figure 3:
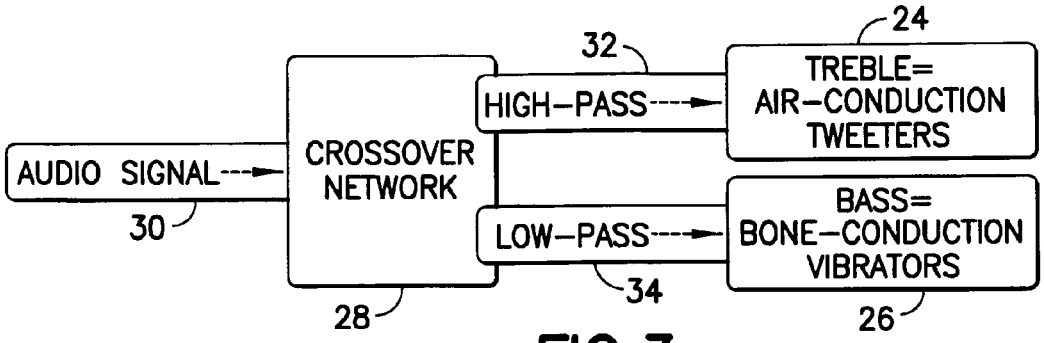
FIG. 3 is a diagram illustrating portions of a system used in the example of FIG. 1.

Referring also to FIG. 3, the circuitry 16 in this example includes an audio crossover or crossover network 28. The crossover 28 is configured to split the incoming audio signal 30 from the source 20 into frequency bands that can be separately routed. In this example the crossover 28 is configured to output a first frequency band component 32 and a second frequency band component 34. However, in an alternate example embodiment, more than two outputs could be provided. The output comprising the first component 32 is connected to an input of the first transducer(s) 24. The output comprising the second component 34 is connected to an input of the second transducer(s) 26.

The crossover 28 is configured to filter low-frequencies from the electrical audio signal 30 and form the first component 32 as a high-frequency band component. The crossover 28 is configured to filter high-frequencies from the electrical audio signal 30 and form the second component 34 as a low-frequency band component. However, in an alternate embodiment portions of band components 32, 34 might be the same, at least at mid-frequencies. With this type of system, the first transducer(s) 24 can be used for treble (as air-conduction tweeters), and the second transducer(s) 26 can be used for bass (as bone-conduction woofers) for a combined audio delivery result to the user.

Figure 4:
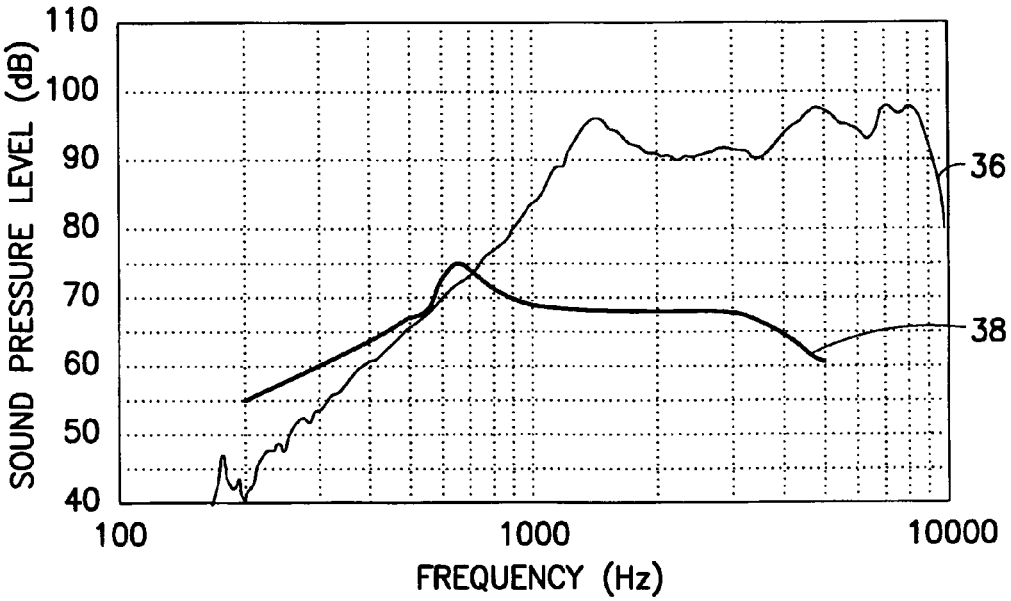
FIG. 4 is a graph illustrating sound pressure levels versus frequency for an example air-conduction transducer and an example bone conduction transducer.

Referring also to FIG. 4, an example graph is shown of frequency characteristics of sound pressure level for an air-conduction transducer (illustrated by line 36) and for a bone-conduction transducer (illustrated by line 38). If the crossover cut-off frequency is provided at about 1500 HZ, for example, the first transducer(s) 24 could have an input from the crossover 28 as the first component 32 of frequencies of the audio electrical signal 30 of about 1500 Hz and higher, and the second transducer(s) 26 could have an input as the second component 34 from the crossover 28 of frequencies of the audio electrical signal 30 of about 1500 Hz and lower. The acoustic signals or sound waves from the first transducer(s) 24 can be sent to the ear canal(s) of the user's ear(s) from the frame 12. At substantially the same time, the vibrations from the second transducer(s) 26 can be sent to the bone of the user's skull. The two different types of transmissions to the user ear (sound via ear canal and vibrations via bone conduction to the inner ear) produce a combination or combined resultant delivery of audio information to the user.

The example described above can provide an audio reproduction, and can be provided as a personal, wearable system for the delivery of sound. Like conventional headphones or earbuds, the example described above may present audio to a person wearing the device, but without blocking the ear canals or obstructing the ears. Unlike conventional headphones, this can permit unobstructed hearing of external sound in the user's surrounding environment. The example described above can also avoid insertion and occlusion loss, and the subjective alteration in volume and timbre of the user's own voice, occasioned by conventional devices inserted in the ear canal. Thus, the example described above may be used to support an "always on, always connected" electronic communication, without hindering natural perception of the environment, or of one's own voice. This facilitates user safety and social interaction.

Bone-conduction hearing appliances have a long history. An outline is now presented of other techniques of achieving goals of providing discrete sound to the user and preserving sensitivity to environmental sound. For military personnel and emergency responders, bone-conduction audio permits the transmission of sound without interference, and allows the user to hear communication signals without obstructing the ears. Air-conduction transducers can also deliver sound without blocking the ears, by placement extremely close to the ear canal. Alternatively, headphone transducers can be held against the ears by tension from a supporting structure through acoustically-transparent foam, which permits the passage of environmental sound. Headphone transducers can be supported within acoustically-isolating cups surrounding the ear, with provisions for mixing environmental sound picked up by external microphones into the signal delivered to the wearer.

An example embodiment can provide a headset combining bone-conduction vibrators and air-conduction transducers proximate to the ears, with a crossover network which directs low-frequency components of the audio signal to the bone-conduction vibrators (functioning as woofers for example), and high-frequency components to the air-conductors (functioning as tweeters for example). The air-conduction transducers may be employed so as not to block the ear canals or significantly obstruct the ears themselves. This can result in full-spectrum sound delivery with unobstructed hearing.

Bone-conduction vibrators may be deployed (for example) in contact with the mastoid process, against the forehead, or over the outer-ear, in contact with the head. Design considerations for different realizations include efficiency of sound transmission, comfort, and cosmetic appearance. Either electromagnetic dynamic or piezoelectric transducers could be used as bone-vibrator elements for example.

In the example embodiment described above the crossover 28 separating low-frequency and high-frequency audio signals is fixed, depending on the choice and configuration of transducers, and does not need to be tunable. However, in an alternate embodiment one or more could be tunable. The crossover 28 could be realized in the form of discrete analogue components, integrated analogue circuitry, or a digital signal processor for example. In one type of example the low-frequency portion of the audio signal may be monophonic, and the high-frequency portion of the audio signal may be presented in stereo. Because the speed of sound is much greater in bone and liquid than in the air, it is difficult to achieve the interaural time delays supporting stereo separation of signals to the user's ears using bone-conduction alone. Stereo sound can be delivered in the form of separate high-frequency channels directed to air-conduction transducers at each ear.

As noted above, the two different types of transmissions to the user ear (sound via ear canal and vibrations via bone conduction to the inner ear) can be sent from the crossover at substantially the same time. However, in one type of embodiment the circuitry might be configured or programmed to delay transmission of the second component 34 relative to the first component 32 to compensate for the transmission speed differential of bone and liquid versus air as noted above to thereby synchronize delivery of the two energy forms to the ear to arrive at a substantially same time. This is because bone conducted sound is more than 10 times faster than air conducted sound.

The air-conduction transducers could be electromagnetic dynamic, piezoelectric, electrostatic or thermoacoustic elements for example. If desired to minimize sound propagation outside the wearer's personal space, they should be deployed proximate to the ears. In addition, sound may be directed from the transducers to each ear through tubes that minimize sound radiation, except at the openings of the tubes adjacent the ears. Further minimization of sound propagation outside the wearer's personal space may be achieved by using multipole sources such as dipole transducers. The sound level diminishes more rapidly with distance from multipole than from monopole sources ($1/r^2$ for a monopole, with sound diminishing as $1/r^4$; $1/r^3$ for a dipole, with sound diminishing as $1/r^6$).

In one example embodiment, the headset is realized in an eyeglass frame, with bone-conduction vibrators in contact with the skull, such as under mild spring bias for example. The crossover network separating audio signals into low-frequency and high-frequency components can have a sharp transition, and may be performed by digital signal processing. Dipole or multipole air-conduction transducers may be contained in, or dependent from, the temples of the spectacle frame, and the transducer(s) with sound directed into close proximity with the opening of the external ear, such as through parallel tubes for example. The respective length and position of the openings of the tubes may be designed and adjusted to provide good signal amplitude which rapidly diminishes with distance.

Bone-conduction elements can deliver sound without obstructing the ears, but are more suitable for speech signals than music or for high-fidelity sound reproduction, because they significantly roll off the high frequencies of audio signals. Bone-conduction elements are more suitable for monophonic than for stereo sound. The examples described above overcome these obstacles by utilizing bone-conduction only for low-frequency components of a signal, and permitting stereo separation of the high-frequency components. Because the low-frequencies are not present in the signal delivered to the ears by air-conduction, the signal is less audible to others in the vicinity of the headset user. This characteristic may be augmented by the use of multipole sound sources for the air-conduction elements, so their audibility falls off rapidly with distance.

An example embodiment headset can be worn for extended periods of time without discomfort. It can be worn outdoors and in social situations, with awareness of the surrounding environment, full spatial hearing, and unimpaired conversation.

FIG. 3 diagrams one aspect of an example which illustrates an audio signal is divided into high-pass and low-pass components, which are amplified and directed to air-conduction and bone-conduction audio transducers respectively, configured in a wearable form such as eyeglasses, a cap, a hat or a headband, or the range of supports employed for conventional earphones or headphones. FIG. 1 is an implementation of the system shown in FIG. 3 which illustrates a pair of eyeglasses equipped with bone-conduction vibrators and air-conduction speakers.

Figure 5:
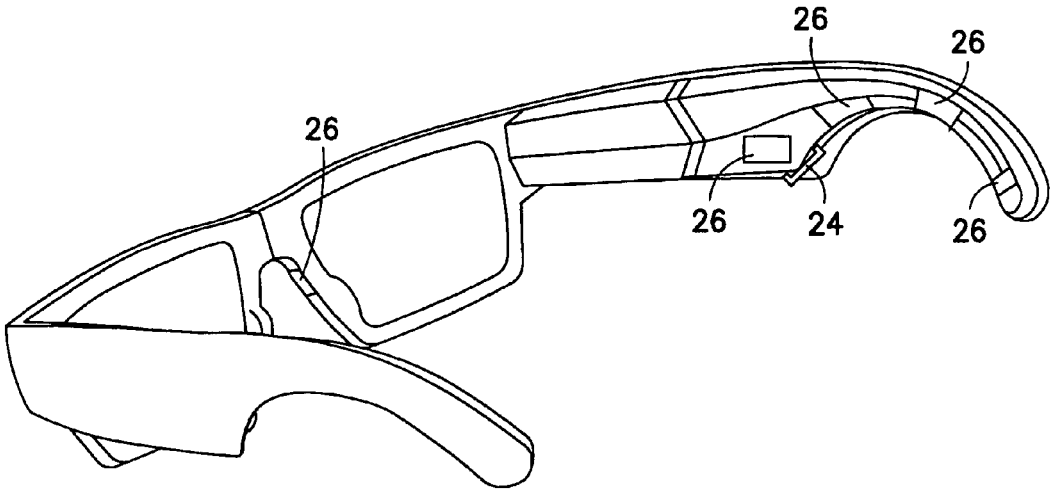
FIG. 5 is a perspective view illustrating some example locations of a bone conduction transducer on an eyeglass frame.

FIG. 5 is a perspective view of an alternate embodiment. This embodiment shows several possible locations on the eyeglasses for the bone-conduction vibrators 26.

Figure 6:
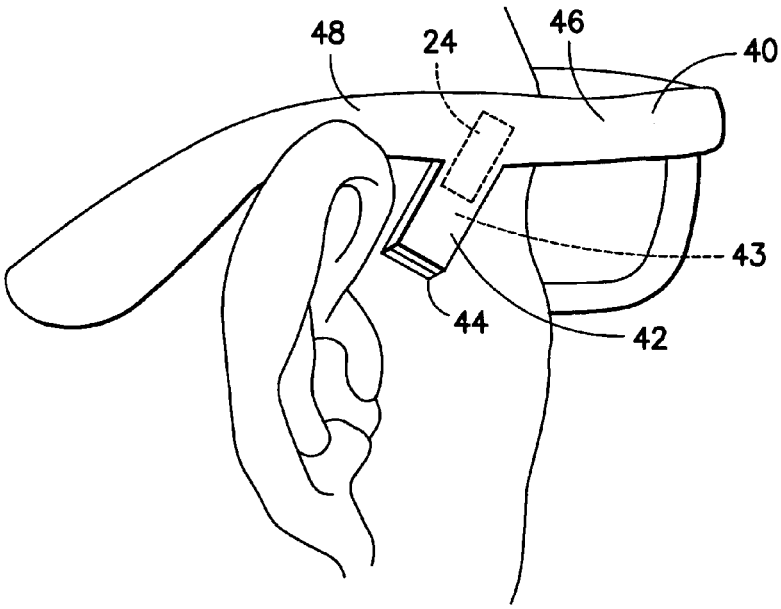
FIG. 6 is a perspective view illustrating an alternate example embodiment.

FIG. 6 is a perspective view of another alternate embodiment. In this example the frame 40 of the eyeglasses has an extension 42 which extends towards the user's ear. The extension 42 forms at least one channel 43 with an open end 44. The air-conduction transducer 24 is located in the main section 46 of the temple arm 48 such that sound waves are directed into the at least one channel 43 to exit from the channel 43 at the open end 44 proximate the entrance to the user's ear. In the example shown in FIG. 6 the transducer 24 is a dipole air-conduction transducer in a cavity directed at the opening of the ear.

Figure 7:
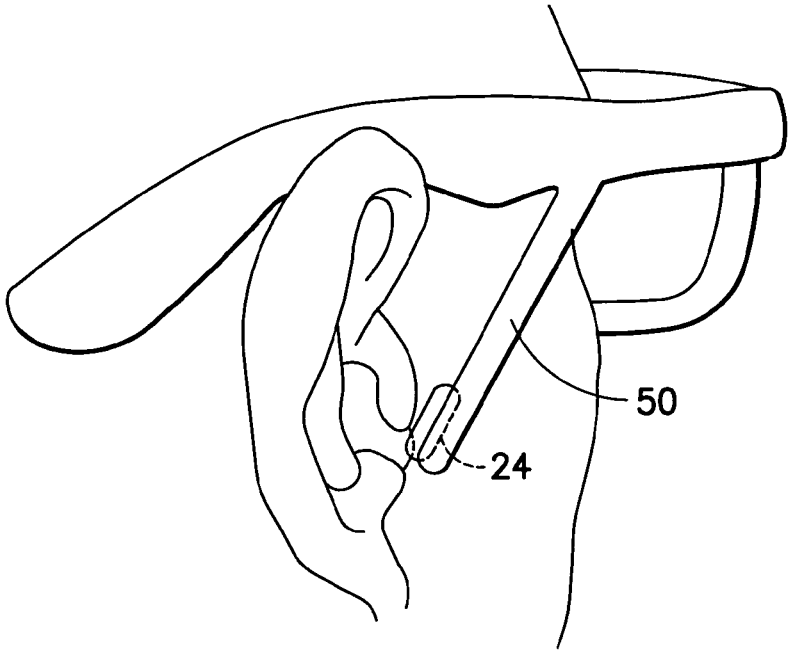
FIG. 7 is a perspective view illustrating another alternate example embodiment.
Figure 8:
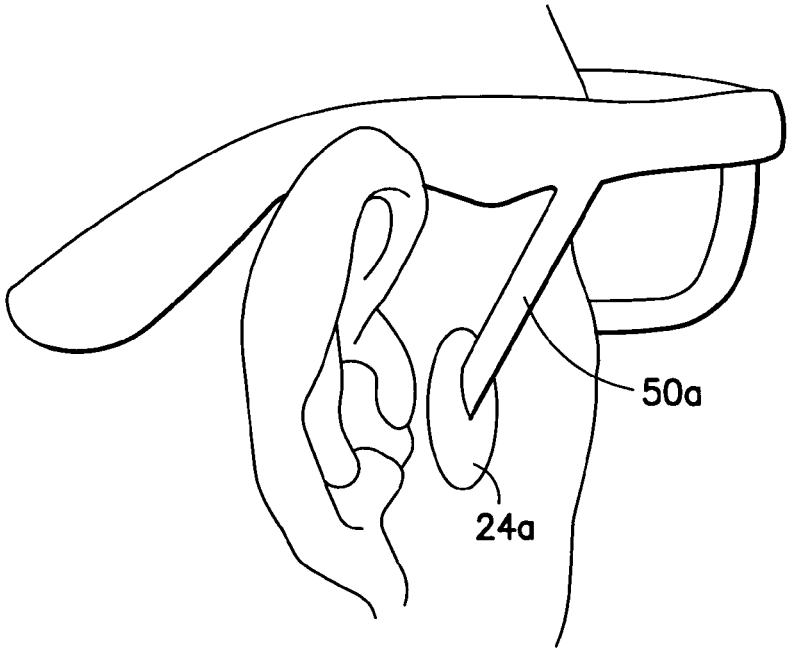
FIG. 8 is a perspective view illustrating another alternate example embodiment.

FIG. 7 shows an alternate embodiment where a conventional air-conduction element 24 is suspended by an extension 50 of the frame very close to the entrance to the ear. FIG. 8 shows an alternate embodiment where a planar air-conduction element **24*a* is suspended very close to the ear by an extension 50*a*** of the frame.

Figure 9:
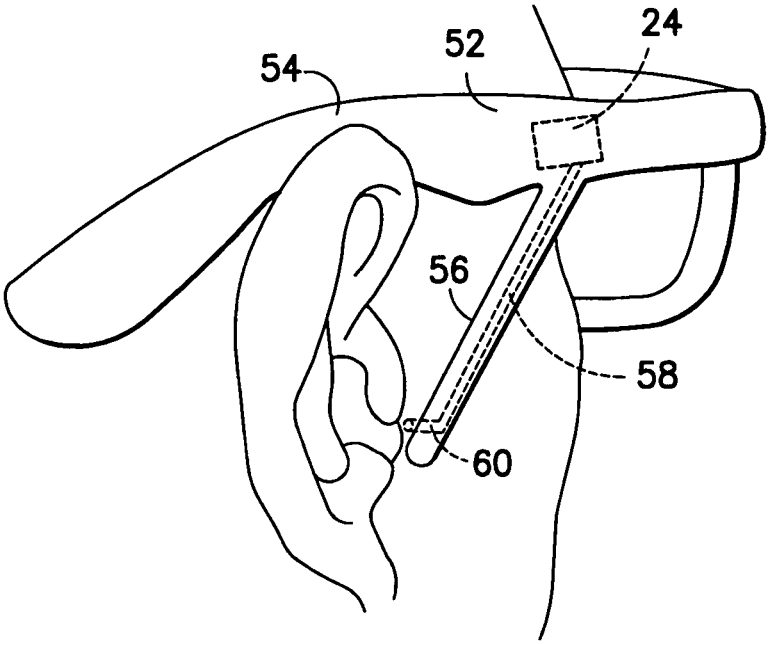
FIG. 9 is a perspective view illustrating another alternate example embodiment.

FIG. 9 shows an alternate embodiment with an air-conduction transducer 24 located in the main section 52 of the temple arm 54. The frame has an extension 56 towards the user's ear. A sound tube 58 extends from the air-conduction transducer 24, through the extension 56, and has an open end 60 at the entrance to the user's ear. Sound waves are directed into the tube 58 to exit from the tube at the open end 60 proximate the entrance to the user's ear.

Figure 10:
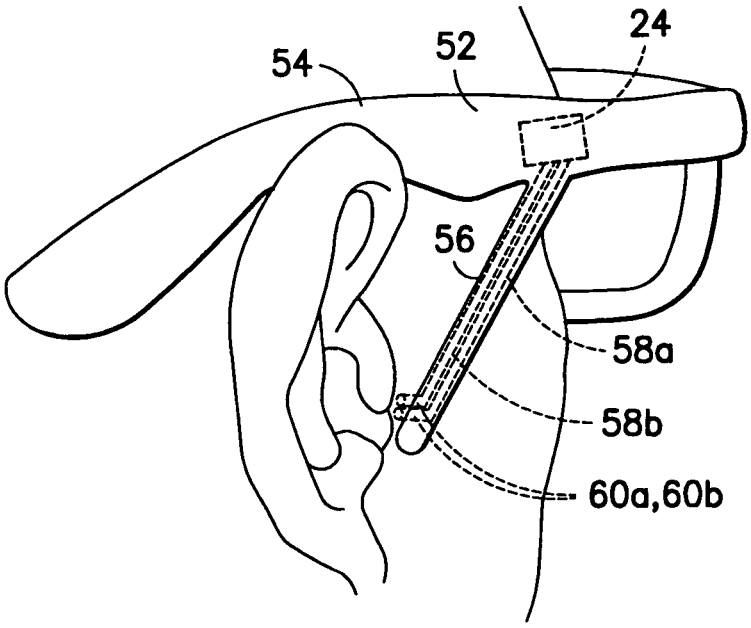
FIG. 10 is a perspective view illustrating another alternate example embodiment.

FIG. 10 shows an alternate embodiment with the air-conduction transducer 24 located in the main section 52 of the temple arm 54. The frame has the extension 56 towards the user's ear. Two sound tubes **58*a*, 58*b* extend from the air-conduction transducer 24, through the extension 56, and have open ends 60*a*, 60*b* at the entrance to the user's ear. Sound waves are directed into the tubes 58*a*, 58*b* to exit from the tube at the open ends 60*a*, 60*b* very close to the opening of the ear. The transducer 24 could be a dipole transducer with each of the substantially parallel tubes 58*a*, 58*b*** extending from a respective lobe of the transducer.

Figure 11:
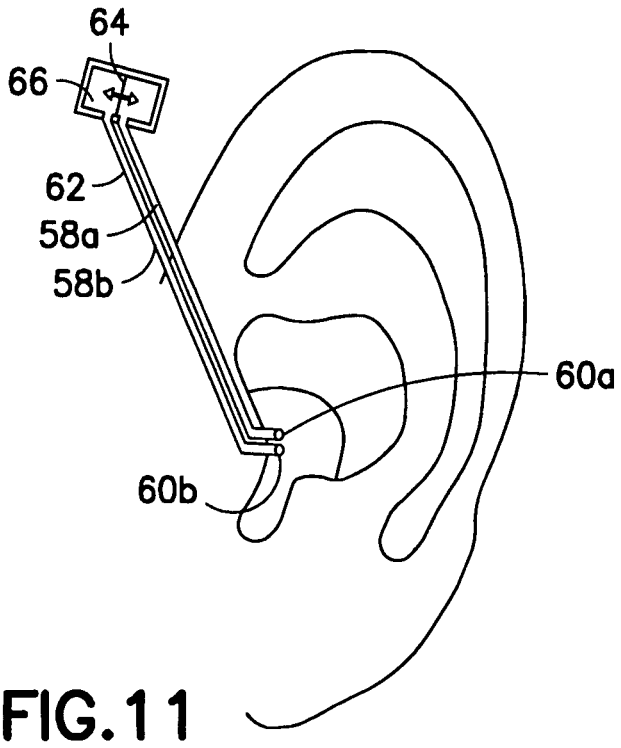
FIG. 11 is a diagram illustrating components of the example embodiment shown in FIG. 10.

FIG. 11 presents a conceptual diagram of a dipole tube 62: a diaphragm 64 driven by a sound signal separates a chamber 66; opposite halves of the chamber divided by the diaphragm increase and decrease in pressure alternately, 180 degrees out-of-phase. The two halves of the chamber each have an opening to a tube **58*a*, 58*b*. The two out-of-phase signals are conducted from the chamber to the ends 60*a*, 60*b* of the tubes, which can be placed near the opening of the ear. The lengths of the tubes 58 and positions of the openings 60** can be designed to supply clearly audible sound pressure levels close to the ear. As the two signals cancel one another more and more completely with increasing radius, sound from them diminishes more rapidly with distance than from a monopole source.

Features of the embodiments described above may be used in an audio peripheral or for a near-eye display. An audio peripheral may be, for example, an accessory such as a headset. Audio playback may be suitably configured by incorporating a bone conduction transducer and a conventional transducer in order to adjust playback bandwidth and/or directionality. An example embodiment may comprise a headset design (or any similar accessory such as spectacles) wherein bone conduction and air-conduction transducers are controlled using a crossover network such that the user is provided a full band audio spectrum without blocking the ear canal entrance. This provides the possibility of having a more private playback with air-conduction playback possibly designed as directional. Air-conduction playback may be configured with a dipole or other multipole source. Dipole and other multipole sources are intrinsically anisotropic. They do not radiate sound symmetrically and therefore exhibit directivity. In one example a speaker is provided from which sound diminishes radically with distance. This allows air-conduction sound that remains audibly confined to the wearer's personal space.

As an example, an electrical audio signal ranging from 300 Hz to 10 kHz is transmitted to the receiver in the circuitry 16, demodulated, pre-amplified, and divided by a crossover network into a bass signal ranging from 300-1500 Hz, and a treble signal ranging from 1500 to 10,000 Hz. The bass signal is input to an audio power amplifier, such as a Class-D audio power amplifier for example, and used to drive one or more bone-conduction transducers (which can effectively function as "woofers"). The treble signal is input to an audio power amplifier, such as a Class-D audio power amplifier for example, and used to drive one or more air-conduction transducers, such as piezoelectric transducers for example (which can effectively function as "tweeters"). This reproduction chain can provide a monaural realization. Stereo requires two such chains.

Examples of bone conduction transducers include VONIA bone conductors and smaller HUAYING bone conductors. Examples of air conductor transducers include MURATA piezoelectric air conductors. As seen in FIG. 4, the bone conductor transducer rolls off significantly above 3000 Hz, and the air conductor transducer rolls off below 1000 Hz. Piezoelectric speakers may be employed in a side-fire configuration, but both sides of the diaphragm may be open to the air, and the speaker can act as a dipole sound source.

One example of intended operation ranges/bandwidths includes 300 Hz~10 kHz. Low-frequency response may be extended based upon the type of bone-conduction transducers used. Crossover cut-off frequency for the electrical audio signal may be 1500 Hz for example. The cut-off may be adjusted for different configurations of elements. Stereo imaging (and cueing with synthetic three-dimensional sound) may be provided. This is difficult to achieve with bone-conduction alone, but can be provided with features of the embodiments described above. The reason why stereo imaging (and cueing with synthetic three-dimensional sound) is difficult to achieve with bone-conduction alone is because the speed of sound is so much greater in bone and fluid than in air, that it is difficult to create perceptible interaural time differences with bone-conduction elements. However, with features of the embodiments described above, perceptible interaural level differences are achievable, so the spatial effect of "panning" can be supported to some degree, but sound at nominal levels from a bone-conduction transducer at any point on the head will typically be heard by both ears. The audio frequency of 1500 Hz corresponds to a wavelength of about 22.87 cm (about 9 inches).

Frequencies below this are consequently perceived as non-directional, so this seems a natural range for bone-conduction elements.

The HUAYING bone conductors do not appear to suffer from harmonic distortion at their high end. In this respect, they seem genuinely linear devices; frequencies above a certain value (perhaps about 1500 Hz for example) get turned into heat, rather than distorted sound. For these devices, the crossover network does not need to change the sound of the bass, it simply conserves power by removing low-frequency energy from the signal before the power amplifier stage.

A suitable choice for drivers/amplifiers for the bone conductors is Class-D audio amplifiers. They deliver good sound quality and offer low power consumption. They may generate EMI in some design configurations, and that may be addressed in layout and shielding. For air conductors, both Class-G and Class-D audio amplifiers were tested. They delivered comparable sound quality, but Class-D outperforms Class-G in power consumption. A TEXAS INSTRUMENTS' TPA2010D1 may be used, for example, for both bone- and air-conduction elements.

Figure 12:
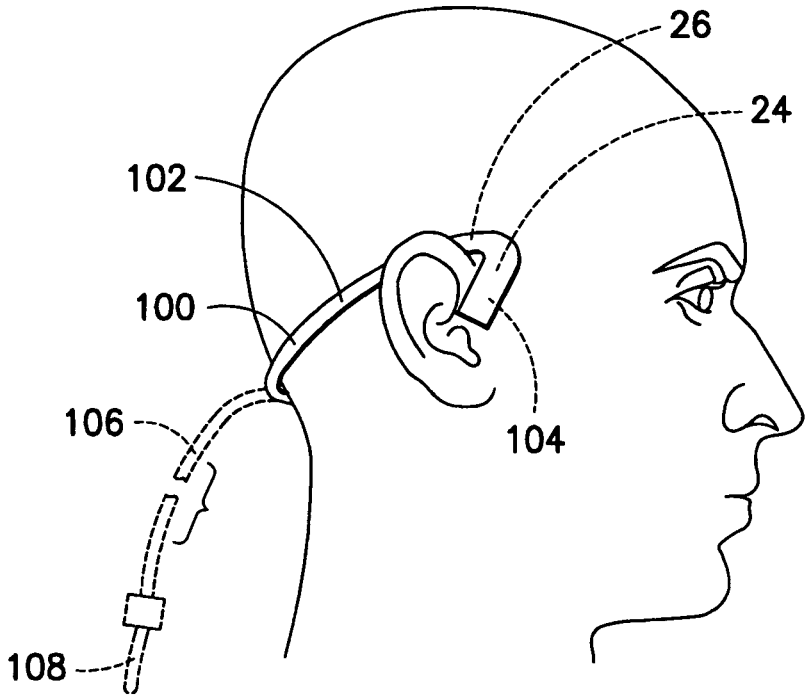
FIG. 12 is a diagram illustrating another example embodiment.

Referring also to FIG. 12, as noted above features may be provided in an accessory. FIG. 12 shows an example of a headset 100 which is not in the form factor of eyeglasses. The headset 100 has a frame 102 which can be supported on a user's head, such as on the ears. The headset 100 includes at least one bone conduction transducer 26 and at least one air-conduction transducer 24. The frame 102 forms a sound wave channel 104 from the transducer 24 to the entrance proximate, but spaced from, the entrance to the user's ear. The crossover 28 might be provided in the frame 102 or in another device, such as a smartphone or music player for example. The headset could have circuitry including a wireless receiver for receiving the audio signals or components, or could have a cable 106 with removable plug 108 for example.

An example embodiment may be provided as an apparatus 10 (or 10 and 20) comprising an air-conduction transducer 24 configured to convert a first frequency band component 32 of an electrical audio signal 30 into acoustic energy to be delivered to an ear canal of a user; and a body vibration conduction transducer 26 configured to convert a second at least partially different frequency band component 34 of the electrical audio signal 30 into mechanical energy to be delivered to the skull of the user, where the apparatus is configured to deliver both forms of the energies to the user to provide a combined audio delivery result to the user.

The apparatus may comprise a frame 12 having the transducers connected thereto, where the frame is sized and shaped to be supported on a head of the user. The frame may comprise an eyeglass frame. The frame may comprise at least one elongate tube 43 or 58 for transmitting the acoustic energy from the air-conduction transducer towards the ear of the user. The apparatus may be sized and shaped such that, when the apparatus is worn on a head of the user, the apparatus does not obstruct the ear or block an ear canal of the ear. The apparatus may further comprise a crossover 28 electrically connected to inputs of the transducers, where the crossover is configured to separate the electrical audio signal into the first and second frequency band components, and where the apparatus is configured to deliver the first component to the air-conduction transducer and deliver the second component to the bone conduction transducer. The crossover 28 may be configured to separate a high-frequency band from the electrical audio signal as the first component, where a low-frequency band of the electrical audio signal is filtered from the electrical audio signal by the crossover to create the first component. The crossover may be configured to separate a low frequency band from the electrical audio signal as the second component, where a high-frequency band is filtered from the electrical audio signal by the crossover to create the second component. The crossover 28 may be configured to deliver the low-frequency band as monophonic and the high-frequency band as stereophonic. The air-conduction transducer 24 may form a multipole sound source. The air-conduction transducer may be a dipole speaker, where the apparatus comprises at least partially separate paths to deliver sound waves from each lobe of the dipole speaker towards the ear of the user. The air-conduction transducer and the body vibration conduction transducer may be configured to operate independently relative to each other, being dependent merely upon their respective input signals. The apparatus may be configured to deliver both forms of the energies to the user at a substantially same time.

Figure 13:
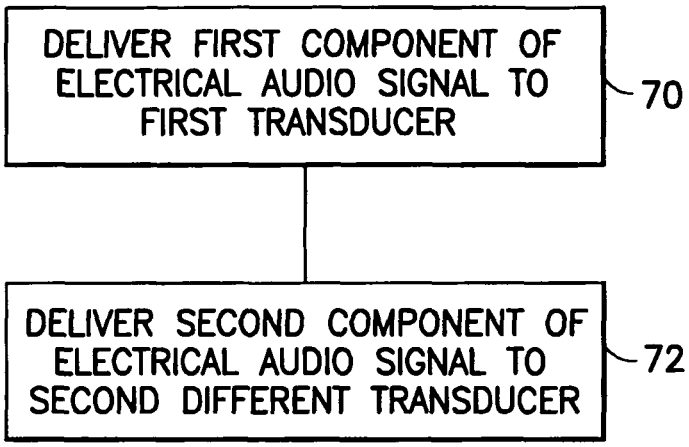
FIG. 13 is a diagram illustrating steps of an example method.

Referring also to FIG. 13, an example method may comprise delivering a first component of an electrical audio signal to a first transducer as indicated by block 70, where the first component 32 comprises a high-frequency band of the electrical audio signal, and where the first transducer 24 is configured to convert the first component into acoustic energy; and delivering a second component of the electrical audio signal to a second different transducer as indicated by block 72, where the second component 34 comprises a low-frequency band of the electrical audio signal, where the second transducer is a bone conduction transducer 26 configured to deliver vibration to a hearing system of a user, and where the acoustic energy and the vibrations are delivered to the user at substantially the same time for a combined audio delivery result.

Delivering the first component may comprise filtering the low-frequency band from the electrical audio signal to form the first component. Delivering the second component may comprise filtering the high-frequency band from the electrical audio signal to form the second component. A crossover 28 may separate the high-frequency band from the electrical audio signal to deliver as the first component. The first transducer may be a dipole speaker, and sound waves from each lobe of the dipole speaker may be delivered towards an ear of a user by a separate respective tube 58*a*, 58*b*.

An example embodiment may comprise a bone conduction transducer and an air-conduction transducer, typically but not necessarily with both transducers operating in different frequency ranges. Both transducers do not need to interact with each other and the transducers do not need to use mechanical properties of each other. An example embodiment does not block the ear canal entrance. Therefore, external sounds are not isolated. Both transducers do not need to be positioned inside the same cage, and the air-conduction transducer can be directional. An example embodiment can possibly deliver a dipole implementation.

In one type of example the bone conduction transducer could be an array of multiple transducers suitably positioned in a single apparatus, such as headset. There are also transducers operating towards soft tissues rather than a bone. Bone conduction is a rather complex mechanism where such bone structure is excited, but also transmission can interact with soft tissues. As used herein, a body vibration conduction transducer could be a bone conduction transducer, a tissue conduction transducer, and combined bone and tissue conduction transducer, or any other transducer intended to transmit vibrations directly via a body part to the hearing system.

A body vibration conduction transducer could be designed for soft tissues separate from bone conduction. Such a body vibration conduction transducer(s) may be a bone conduction transducer, a transducer exciting soft tissues, or a combination for example. One type of example could comprise a bone conduction transducer and a soft tissue conduction transducer in a same apparatus. The vibrations from these two different body vibration conduction transducers could be delivered at a substantially same time, and/or could be switched or swapped based upon predetermined criteria, and/or could be configured to correlate to at least partially different frequency bands. Each transducer in the examples described above is independent. They operate independently. Although they are independent and can operate independently, they can operate simultaneously. Energies can be delivered to a user's hearing system that would comprise no air-conduction transducers (i.e. use of only bone, soft tissues, etc. conduction transducers). It is also possible that a user could independently control these transducers. For example, there may be some situations where the user activates only a bone conduction transducer, but not other one(s) of the transducers. Therefore, it is understood that such audio delivery could be independent.

An example embodiment may be provided as an apparatus comprising a first transducer 24; a second different transducer 26 comprising a bone conduction transducer; and a crossover 28 connected to the first and second transducers, where the crossover 28 is configured to separate an electrical audio signal 30 into a first frequency band component 32 and a second frequency band component 34, where the second frequency band component is at least partially different from the first frequency band component, and where the apparatus is configured to provide the first component to the first transducer and the second component to the bone conduction transducer.

The first transducer may be an air-conduction transducer, and the first frequency band component may comprise a high-frequency band of the electrical audio signal. The second frequency band component may comprise a low-frequency band of the electrical audio signal, where the apparatus is configured to deliver the first and second components to the transceivers at a substantially same time. The apparatus may further comprise a frame having the transducers connected thereto, where the frame is configured to be supported on a head of a user, where the frame comprises at least one elongate tube 58 for transmitting acoustic energy sound waves from the first transducer towards an ear of the user, and where the apparatus is sized and shaped such that, when the apparatus is worn on the head of the user, the apparatus does not block an ear canal of the ear.

Figure 14:
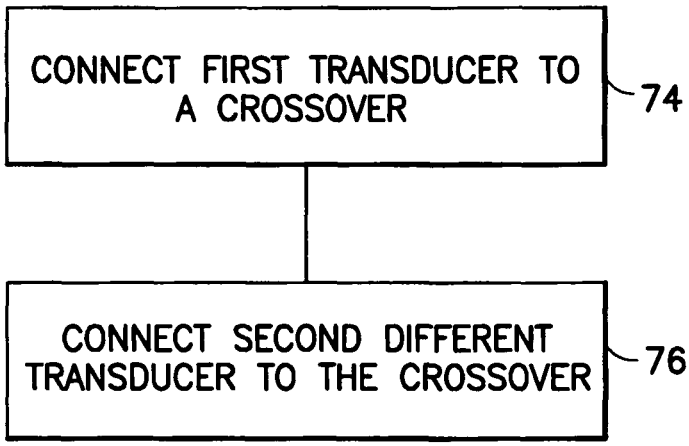
FIG. 14 is a diagram illustrating steps of another example method.

Referring also to FIG. 14, an example method comprises connecting a first transducer 24 to a crossover as indicated by block 74, where the crossover is configured to form an incoming electrical audio signal 30 into a first frequency band component 32 and a second frequency band component 34, where the second frequency band component is at least partially different from the first frequency band component, and where crossover is configured to send the first frequency band component to the first transducer; and connecting a second different transducer 26 to the crossover as indicated by block 76, where the second transducer comprises a bone conduction transducer, where the crossover is configured to send the second frequency band component 34 to the bone conduction transducer 26, where the crossover is configured to send the first and second components to the transducers at a substantially same time.

In practice, the quality could be reduced when either of these transducers operates one at a time as opposed to simultaneous operation.

Because bandwidth is controlled using a cross-over during the simultaneous operation, and because the system is able to switch to either of the transducers, the playback levels of each transducer types can be also controlled. For example, the level of air-conduction playback (or vice versa) may be independently controlled.

As noted above, the air-conduction transducer can form a multipole sound source such as a dipole sound source. The sound from a dipole sound source of this type diminishes radically with distance, and this allows the air conducted sound to remain audibly confined to the wearer's personal space. The cancellation of the signal from opposite sides of the diaphragm can make the directivity of the radiation pattern higher at low-frequencies and mid-frequencies than at high-frequencies. Therefore, the sound can be preferentially directed to the user's ear.

Figure 15:
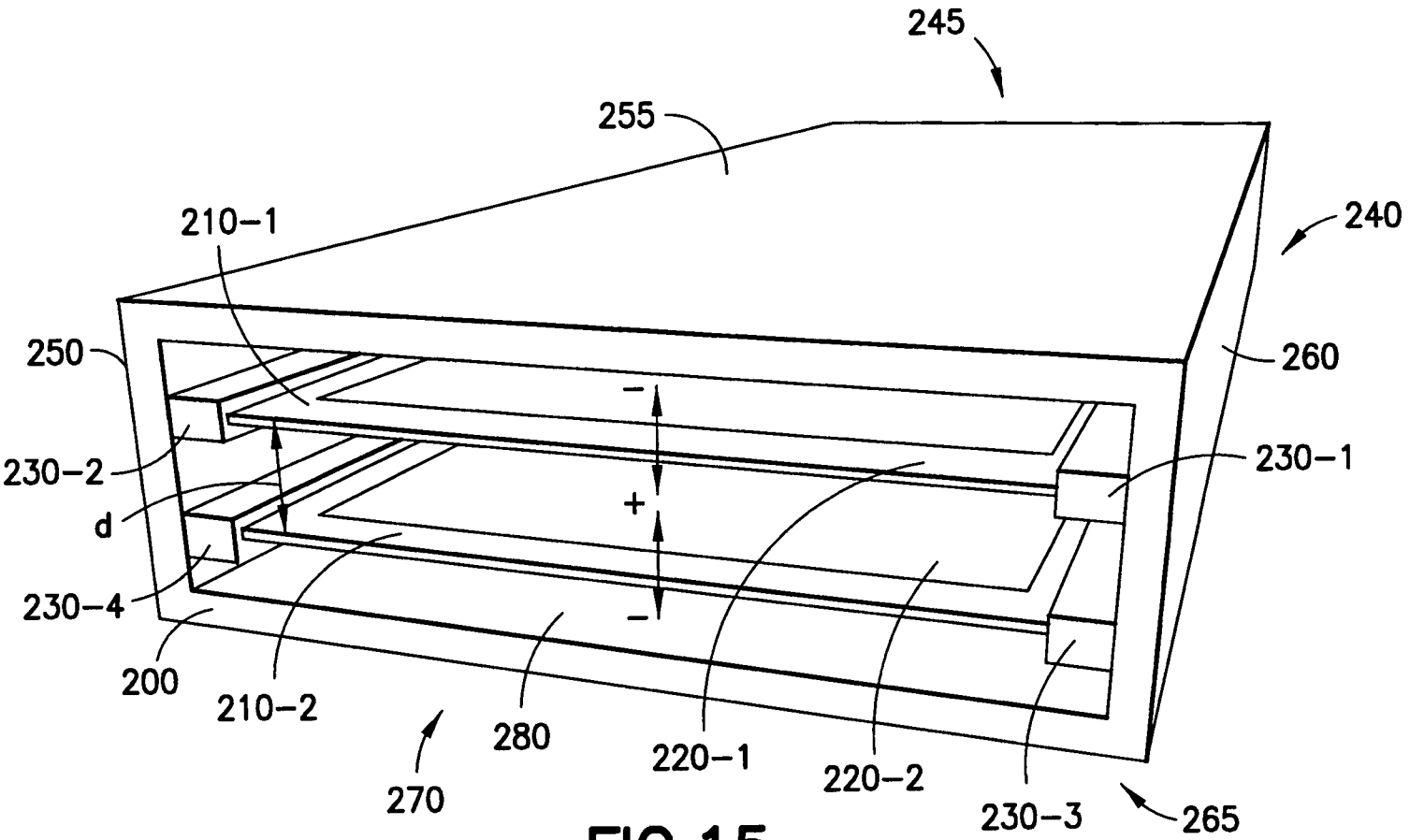
FIG. 15 is a perspective view of a multipole (e.g., quadrupole) air conductor transducer illustrating another alternate example embodiment.

An example of a multipole (e.g., a quadrupole) air conductor transducer 240 suitable for, e.g., transducer 24 is shown in FIG. 15. In this example, an enclosure 200 houses two diaphragms 220-1 and 220-2, which are configured to vibrate out of phase with each other. That is, the "+" and "−" signs indicate the direction of excursion of the diaphragms in successive phases (i.e., first "+" then "−"). The two diaphragms 220 are separated by a distance d. Each diaphragm 220 has a corresponding transducer frame 210 that is mounted within (e.g., in slots not shown) a set of acoustic isolation materials 230-1 and 230-2 (for first diaphragm 220-1) or 230-3 and 230-4 (for second diaphragm 220-2). The acoustic isolation material 230 is connected to the enclosure through known techniques, such as gluing the acoustic isolation material 230 to the enclosure 200.

In this example, the enclosure 200 is a parallelepiped having four sides 250, 255, 260, and 265 and a back 245 that are all closed but having a front 270 that is open. This is an illustration where a side-fire cavity 280 with two diaphragms in a longitudinal quadrupole configuration. In the example, the back 245 of the enclosure is sealed, and the acoustic isolation material 230 continues around the back of each frame so as to isolate both transducers acoustically from the enclosure, and to form an airtight seal between the internal partitions of the enclosure, so that the out-of-phase signals mix together only upon exiting the cavity. The enclosure 200 forms a cavity 280 into which a quadrupole (diaphragms 220 in this instance) is formed.

It is noted that if the enclosure 200 contained only a single diaphragm 220, a corresponding transducer frame 210, and a corresponding set of acoustic isolation materials 230, the enclosure would form a dipole as opposed to a quadrupole.

The air conductor transducer 240 is able to produce directionality patterns (not shown), and it is possible to aim the directionality patterns. A number of different patterns are achievable. There are, however, a large number of integration techniques. It should be noted that the skilled person would understand what it means when directionality for multipoles is adjusted in order to achieve that the sound field is diminished rapidly with distance. Since such playback is close to user, in this regard the user is still able to listen to such audio playback as such playback is occurring in the near field (of the user). An exemplary aim herein is to design such directionality patterns to provide a better privacy with air-conduction transducers whilst vibration conduction is used to transmit low-frequency components.

Features described above can provide an apparatus which:

is not an in-ear configuration and, thus, does not block the ear canal;

can comprise a crossover and, thus, delivers different signals to two transducers;

can comprise a multi-pole solution for high frequency attenuation.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variations which fall within the scope of the appended claims.

What is claimed is:

1. An apparatus comprising:

at least one air-conduction transducer configured to convert a first frequency band component of an electrical audio signal into acoustic energy to be delivered to at least one ear of a user; and at least one body vibration conduction transducer configured to convert a second at least partially different frequency band component of the electrical audio signal into mechanical energy to be delivered to a hearing system of the user, where the apparatus is configured to deliver both forms of the energies to the user to provide a combined audio delivery to the user, where the apparatus comprises a frame having the transducers connected thereto, where the frame comprises at least one elongate tube for transmitting the acoustic energy from the at least one air-conduction transducer towards the ear of the user.

2. An apparatus as in claim 1 where the frame is sized and shaped to be supported on the head of the user.

3. An apparatus as in claim 2 where the frame comprises an eyeglass frame.

4. An apparatus as in claim 1 where the apparatus is sized and shaped such that, when the apparatus is worn on the head of the user, the apparatus does not substantially obstruct the ear or block an ear canal of the ear.

5. An apparatus as in claim 1 further comprising a crossover electrically connected to inputs of the transducers, where the crossover is configured to separate the electrical audio signal into the first and second frequency band components, and where the apparatus is configured to deliver the first component to the at least one air-conduction transducer and deliver the second component to the at least one body vibration conduction transducer.

6. An apparatus as in claim 5 where the apparatus is further configured by one or both of the following:

where the first frequency band component comprises a high-frequency band of the electrical audio signal; or the second frequency band component comprises a low-frequency band of the electrical audio signal.

7. An apparatus as in claim 1 where the at least one air-conduction transducer comprises at least one multipole sound source.

8. An apparatus as in claim 7 where each of the multipole sound sources comprises two diaphragms separated by a distance and configured to vibrate out of phase with each other.

9. An apparatus as in claim 1 where the at least one air-conduction transducer comprises a dipole speaker, and where the apparatus comprises at least partially separate paths to deliver sound waves from each lobe of the dipole speaker towards the ear of the user.

10. An apparatus as in claim 1 where the at least one air-conduction transducer and the at least one body vibration conduction transducer are configured to operate independently relative to each other.

11. An apparatus as in claim 1 where the apparatus is configured to deliver both forms of the energies to the user at a substantially same time.

12. An apparatus comprising:

a first transducer;

a second different transducer comprising a body vibration conduction transducer;

a crossover connected to the first and second transducers, where the crossover is configured to separate an electrical audio signal into a first frequency band component and a second frequency band component, where the second frequency band component is at least partially different from the first frequency band component, and where the apparatus is configured to provide the first component to the first transducer and the second component to the body vibration conduction transducer; and a frame having the transducers connected thereto, where the frame is configured to be supported on a head of a user, where the frame comprises at least one elongate tube for transmitting acoustic energy from the first transducer towards an ear of the user, and where the apparatus is sized and shaped such that, when the apparatus is worn on the head of the user, the apparatus does not block an ear canal of the ear.

13. An apparatus as in claim 12 where the apparatus is further configured by one or both of the following:

the first transducer is an air-conduction transducer, and where the first frequency band component comprises a high-frequency band of the electrical audio signal; or the second frequency band component comprises a low-frequency band of the electrical audio signal.

* * * * *